United States Patent [19]

Fukuda et al.

[11] 4,398,406

[45] Aug. 16, 1983

[54] METHOD FOR PRODUCING COLD ROLLED TITANIUM STRIPS

[75] Inventors: Masahito Fukuda; Akiyoshi Tanabe, both of Kobe; Yasuo Moriguchi, Nishinomiya; Nobuyuki Nagai, Kobe; Kunio Tsuji, Kobe; Yoshihiro Yamaguchi, Kobe; Tomiharu Matsushita, Nishinomiya; Atsuo Mizuta, Kobe, all of Japan

[73] Assignee: Kabushiki Kaisha Kobe Seiko Sho, Kobe, Japan

[21] Appl. No.: 264,405

[22] Filed: May 18, 1981

[30] Foreign Application Priority Data

May 23, 1980 [JP] Japan ..... 55-69174

[51] Int. Cl.[3] ..... B21B 3/00; B21B 27/10; B21B 45/02

[52] U.S. Cl. ..... 72/42; 72/366; 72/700

[58] Field of Search ..... 72/42, 46, 365, 366, 72/700; 148/11.5 F

[56] References Cited

U.S. PATENT DOCUMENTS

| | | | |
|---|---|---|---|
| 3,169,085 | 2/1965 | Newman | 148/11.5 F |
| 3,375,695 | 4/1968 | Knapp | 72/365 |
| 3,496,755 | 2/1970 | Guernsey et al. | 72/700 X |

FOREIGN PATENT DOCUMENTS 54-145349 1/1978 Japan .

OTHER PUBLICATIONS

Japanese Laid-Open Patent Application #145,349, published 1979.

*Primary Examiner*—Ervin M. Combs
*Attorney, Agent, or Firm*—Oblon, Fisher, Spivak, McClelland & Maier

[57] ABSTRACT

A method for producing cold rolled titanium strips having good surface quality. The cold rolling of a titanium strip is carried out under the conditions represented by the following formula:

$$X \leqq (48673/Y^{1.3283})$$

where X is an average grain size (μm) of the pre-cold rolled titanium strip and Y is a diameter (mm) of the roll for the cold rolling.

5 Claims, 8 Drawing Figures

$d = 0.287 \cdot X^{0.329} \cdot Y^{0.437}$ d: MAXIMUM DEPTH OF HYDRODYNAMIC POCKETS (μm)

| | ROLL DIAMETER (mm) | ROLLING SPEED (m/min) |
|---|---|---|
| 1 | 152 | 43 |
| 2 | 254 | 11 |
| 3 | 450 | 54 |
| 4 | 760 | 97 |

$d = 0.287 \cdot X^{0.329} \cdot Y^{0.437}$ d: MAXIMUM DEPTH OF HYDRODYNAMIC POCKETS (μm)

METHOD FOR PRODUCING COLD ROLLED TITANIUM STRIPS

BACKGROUND OF THE INVENTION

1. Field of the Invention

The present invention relates to a method for producing cold rolled titanium strips having good surface quality.

2. Description of the Prior Art

Titanium is a metal susceptible to gall in its fabrication, and the pickup of titanium on a tool surface is easily caused under high pressure and at a high sliding speed. A similar difficulty also occurs in cold rolling. Characteristics of the pickup in the cold rolling of titanium strips are such that in the rolling process, titanium, upon solidification, firmly sticks on the surface of the roll and that once the pickup has started, it markedly increases in subsequent rolling. And once pickup has started, the coefficient of friction rapidly increases and the rolling load increases accordingly, whereupon the surface quality of the rolled strip is degraded and the stability of the rolling operation is greatly disturbed.

Under these circumstances, the present inventors have made a study with the aim of developing means for preventing the pickup in the cold rolling of titanium strips, and have already filed patent applications for the following subject matters.

(1) A method wherein an oil having a saponification value of at least 170 is used as a lublicant for rolling (Japanese Laid-Open Patent Application No. 145349/1979).

(2) A method wherein cold rolling is carried out by forming an oxide coating on the strip surface (Japanese Laid-Open Patent Application No. 88858/1979).

The pickup during the cold rolling can be prevented by employing the above methods (1) and (2), singly or in combination. However, according to the results of further research conducted by the present inventors, it has been found that depending upon the relation between the grain size of the pre-cold rolled titanium strip and the roll diameter, numerous hydrodynamic pockets are formed over the entire surface of the cold rolled strip even when the pickup is prevented at the earliest possible stage, and the surface quality is thereby markedly degraded. Upon a further study of the causes for the formation of hydrodynamic pockets, it has been considered that they are formed due to the formation of a so-called full fluid-film lubrication in which a great amount of the lublicant is introduced into the roll gap. Accordingly, it is considered that it is possible to prevent the formation of hydrodynamic pockets by employing an oil of low viscosity so as to obtain a boundary lubrication. Under these circumstances, the relation between the hydrodynamic pockets and various lublicants which exhibit effective lubrication under a boundary lubrication has been studied, and it has been confirmed that although the formation of hydrodynamic pockets can be reduced to some extent by using an oil of low viscosity, such a procedure is not yet adequate. Thus, with a mere improvement of the lublicant, it is difficult to obtain cold rolled titanium strips having good surface quality.

With the aim to confirm the influences of other conditions in the cold rolling process, an investigation has been carried out on the relation between the formation of hydrodynamic pockets and various factors such as the grain sizes of pre-cold rolled titanium strips, rolling speeds, and roll diameters, and the results as shown in FIG. 1 have been obtained. As is apparent from this FIGURE, although there is no substantial influence of the rolling speeds observed, there is a distinctive interrelation between the depths of hydrodynamic pockets, the grain sizes of the strips, and the roll diameters.

As further prior art references known to the present applicants, there should be mentioned Journal of Japan Institute of Metals, Vol. 37, No.1 (1973), pp 19 to 25, and Journal of Japan Society of Lubrication Engineers, Vol. 18, No. 3 (1973), pp 193 to 202.

SUMMARY OF THE INVENTION

The present invention has been accomplished as a result of further research based on the above mentioned findings, and the gist of the invention resides in that good surface quality is obtained if the cold rolling is carried out under the conditions represented by the following formula $$X \leqq 48673/Y^{1.3283} \quad \text{(I)}$$

where X is an average grain size (μm) of the pre-cold rolled titanium strip, and Y is a diameter (mm) of the roll for the cold rolling.

BRIEF DESCRIPTION OF THE DRAWINGS

FIG. 1 (*b*) is a graph showing the relation between the maximum depth of hydrodynamic pockets and the average grain size and roll diameter.

FIGS. 2 to 7 are microscopic photographs of the surfaces of various cold rolled strips, in which FIG. 2 represents a conventional method, FIGS. 3, 4 and 5 represent comparative methods and FIGS. 6 and 7 represent the method of the present invention.

DETAILED DESCRIPTION OF THE PREFERRED EMBODIMENTS

Figure 1A:
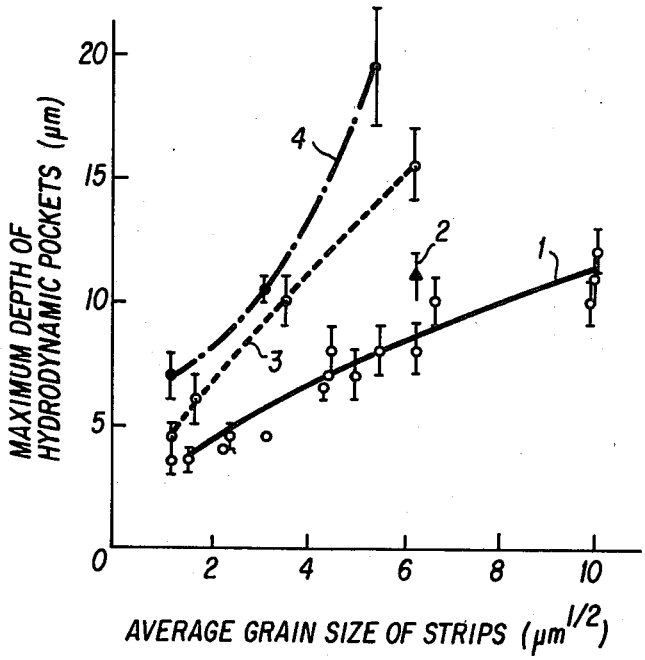
FIG. 1 (*a*) is a graph showing the relation between the average grain sizes of pre-cold rolled titanium strips and the maximum depth of hydrodynamic pockets with various roll diameters for cold rolling and various rolling speeds.

The present inventors have conducted experiments to confirm the interrelation between the depths (d: μm) of hydrodynamic pockets and the average grain sizes (X: μm) of pre-cold rolled titanium strips and the diameters (Y: mm) of the rolls for cold rolling, and it has been found that there is a relation represented by the following formula $$d = 0.287 \cdot X^{0.329} \cdot Y^{0.437} \quad \text{(II)}$$

Accordingly, once the maximum depth (d) of hydrodynamic pockets allowable for practical purposes is determined, the relation between the average grain size (X) of the strip and the diameter (Y) of the roll for cold rolling to be used, may be adjusted thereto. The smaller the values (X) and (Y) are, the smaller the maximum depth (d) of hydrodynamic pockets becomes. Presently, no specific standards have been established for the depths of defects (i.e. hydrodynamic pockets) on the surface of the cold rolled titanium strip. However, there is a demand by the users in this field that "there should be no surface defects having a depth of more than 10 micrometers". Accordingly, in this invention, the allowable maximum depth (d) of hydrodynamic pockets has been set at 10 micrometers and the relation between the average grain size (X) and the roll diameter (Y) has been determined to meet this requirement. Namely, by inserting $d \leqq 10$ into the above formula (II), the following formula (III) is obtained.

$$10 \geqq 0.287 \cdot X^{0.329} \cdot Y^{0.437} \quad \text{(III)}$$

By converting the formula (III), the following formula (IV) is obtained.

$$X \leqq 48673/Y^{1.3283} \quad \text{(IV)}$$

Thus, it is possible to control the maximum depth of hydrodynamic pockets to be not more than 10 micrometers (1) by adjusting the average grain size (X) of the titanium strip to meet the formula (IV) where the diameter (Y) of the roll for cold rolling is already set, or (2) by adjusting the roll diameter (Y) to meet the formula (IV) when the titanium strip having a fixed average grain size (X), is subjected to cold rolling. Further, as it is desirable that the depth of hydrodynamic pockets is smaller, the values (X) and (Y) should preferably be smaller, and there is no lower limit.

In the case where a roll having a small diameter is used, cold rolling can be carried out without trouble even if the grain size of the strip to be cold rolled is relatively large. However, when a roll having a relatively large diameter is used, it is necessary to choose a strip to be cold rolled having a correspondingly small grain size. There is no limitation to a specific means for producing the fine grain size. However, the following method is recommended as it is simple and effective.

In the case where the pre-cold rolled strip is a hot rolled material

In the case of a hot rolled strip, strain is removed and fine recrystallized grains are formed during cooling by air after hot rolling, and therefore strips treated in this manner can be used per se as the strip to be cold rolled. Moreover, a strip is possible to obtain uniform fine recrystallized structures by subjecting it to a heat treatment within a temperature range of from 450° to 850° C. for recrystallization after the hot rolling.

In the case where the pre-cold rolled strip is a cold rolled material

The strip obtained by cold rolling has a high deformation resistance as it has been work-hardened. Accordingly, when the strip is rolled by a roll having a relatively large diameter or when a high strength titanium material is rolled, it is often necessary to soften the material. In such a case, it is possible to adequately soften the material by carrying out an intermediate annealing at a temperature of from 450° to 850° C., and it is thereby possible to maintain fine structures which are necessary to control the hydrodynamic pockets as mentioned above. However, if the cold rolling apparatus has a sufficient rolling capability, the intermediate annealing may be omitted.

It is a common practice in the conventional method for the production of titanium strips to carry out annealing before or during the cold rolling, and this is a means for improving the processability by softening the materials. However, the annealing carried out in the present invention is intended to produce a fine grain size and thereby to minimize the hydrodynamic pockets, and thus, is fundamentally different in its concept.

The present invention is conducted generally as described above, and it is thereby possible to produce cold rolled titanium strips having the maximum depth of hydrodynamic pockets of not more than 10 micrometers and having good surface quality with certainty, by adjusting the grain size of the pre-cold rolled strip and the diameter of the roll for cold rolling to meet the above formula (IV).

Figure 1B:
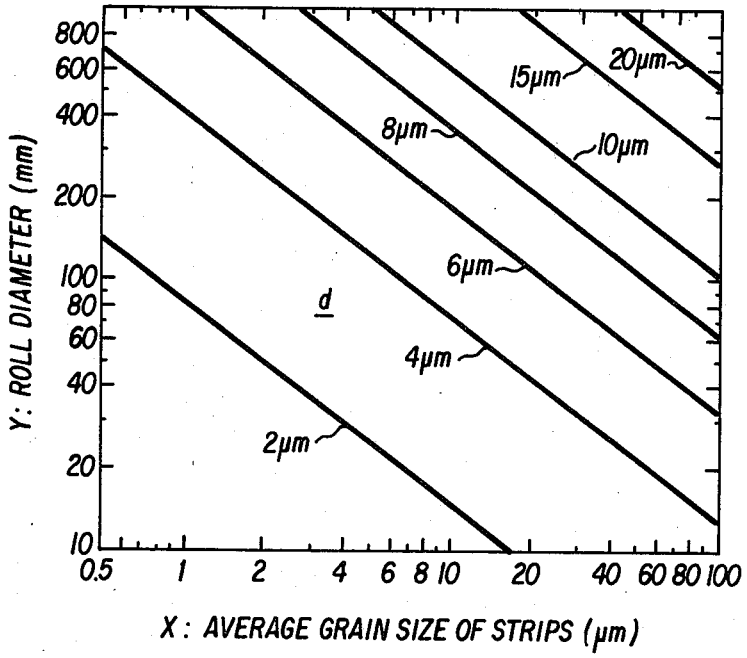

Further, it is possible to make the maximum depth of hydrodynamic pockets smaller by adjusting the grain size of the strip and the diameter of the roll for cold rolling on the basis of the relation shown in FIG. 1 (*b*). For instance, the conditions for obtaining the maximum depth of hydrodynamic pockets at a level of not more than 6 micrometers or not more than 2 micrometers, are $X \leqq (10303/Y^{1.3283})$ or $X \leqq (365/Y^{1.3283})$, respectively.

In the actual operation of the present invention, it is quite effective to apply a known lubricant or to employ such lubricant or oxide coating treatment as disclosed in the above mentioned Japanese Laid-Open Patent Applications. Further, by carrying out a pickling in hydrofluoric-nitric acid after the cold rolling, mottled appearance of the surface due to fine hydrodynamic pockets can be eliminated and the quality can thereby be further improved.

As a result of the experiments conducted recently by the inventors, it has been confirmed that an oil having a saponification value of at least 130 may be used as a lublicant for rolling. However, it is preferred that the saponification value is higher, and it is particularly desirable that the saponification value is at least 170.

Now, the surfaces of the cold rolled strips obtained by a conventional method, comparative methods and the method of the present invention, will be described.

Conventional Method

With use of a roll for cold rolling having a diameter of from 560 to 600 mm a 5% emulsion of a tallow oil (saponification value: 190, viscosity: 70 cSt (38° C.)) as the lubricant, a commercially pure titanium strip of 2.3 mm thickness was cold rolled to 0.8 mm thickness.

Figure 2:
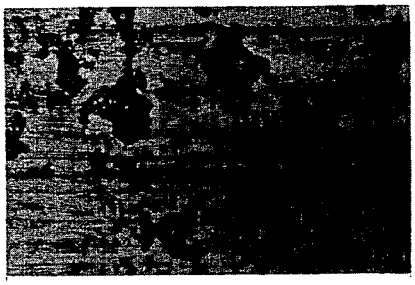

The surface of the cold rolled strip thereby obtained is shown in FIG. 2 (microscopic photograph: 200 magnifications, and the rolling was conducted from left to right). The maximum depth of hydrodynamic pockets was from 10 to 14 micrometers and the surface quality was considerably inferior.

Comparative Method

A commercially pure titanium strip of 5 mm thickness was subjected to an oxide coating treatment, and then cold rolled to 2.3 mm thickness at a rolling speed of 97 m/min. with use of a roll for cold rolling having a diameter of 760 mm and a mineral oil of low viscosity (viscosity: 8.5 cSt (38° C.)) as the lubricant.

Figure 3:
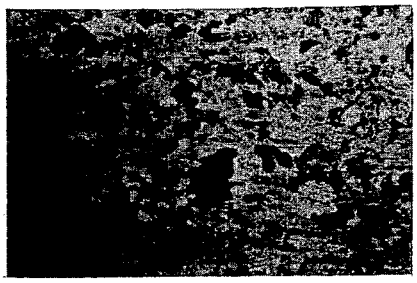

The surface of the cold rolled strip thereby obtained is shown in FIG. 3 (microscopic photograph: 200 magnifications, and the rolling was conducted from left to right). The maximum depth of hydrodynamic pockets was fairly small at a level of from 5 to 8 micrometers, but was not yet small enough.

Comparative Method

A commercially pure titanium strip 2.8 mm thick (obtained by annealing at 800° C. for one hour after hot rolling) having a grain size of from 30 to 50 micrometers, as the pre-cold rolled strip, was cold rolled to 1.0 mm thickness at a rolling speed of 54 m/min. with use of a tallow (saponification value: 190, viscosity: 70 cSt (38°

C.)) as the lubricant and a roll for cold rolling having a diameter of 450 mm. In this case, the depth of hydrodynamic pockets calculated by the above formula (II) was from 12.7 to 15 micrometers.

Figure 4:
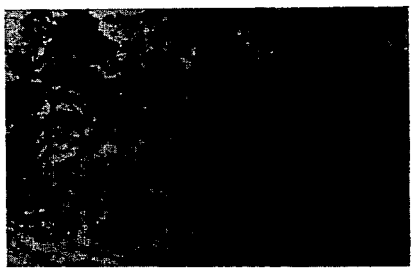

The surface of the cold rolled strip thereby obtained, is shown in FIG. 4 (microscopic photograph: 200 magnifications, and the rolling was conducted from left to right). The maximum depth of hydrodynamic pockets was extremely great at a level of from 14 to 17 micrometers.

Figure 5:
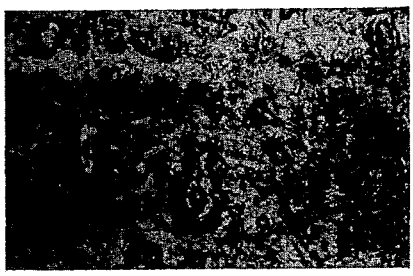

Further, this cold rolled strip was subjected to a pickling in hydrofluoric-nitric acid for about 5 micrometers on one side, and the surface thereby obtained, is shown in FIG. 5 (same as above). The depth of the remaining hydrodynamic pockets was still from 14 to 17 micrometers.

Method of the Present Invention

A commercially pure titanium strip as hot rolled of 2.8 mm thick (grain size: from 1 to 2 micrometers), as the pre-cold rolled strip, was cold rolled to 1.0 mm thick at a rolling speed of 54 m/min. with use of tallow (saponification value: 190, viscosity: 70 cSt (38° C.)) as the lubricant and a roll for rolling having a diameter of 450 mm. In this case, the depth of the hydrodynamic pockets calculated by the formula (II) was from 4.1 to 5.2 micrometers.

Figure 6:
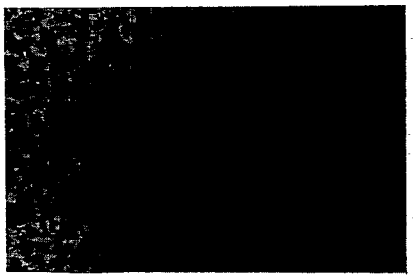
Figure 7:
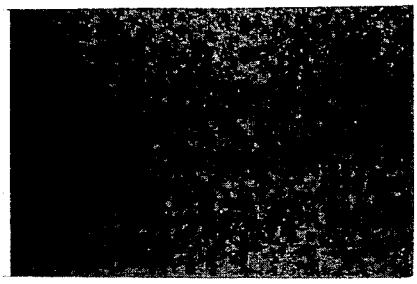

The surface of the cold rolled strip thereby obtained, is shown in FIG. 6 (microscopic photograph: 200 magnifications, and the rolling was conducted from left to right). The maximum depth of the hydrodynamic pockets was as small as from 4 to 5 micrometers, which were substantially equal to the calculated values. Further, this cold rolled strip was subjected to a pickling in hydrofluoric-nitric acid for about 5 microns on one side, and the surface thereby obtained is shown in FIG. 7 (same as above). Although there was no substantial change in the depth of the remaining hydrodynamic pockets, mottled appearance due to fine hydrodynamic pockets was reduced and the surface quality was remarkably improved.

What is claimed is:

1. A method for producing a cold-rolled titanium strip, comprising:

predetermining the average grain size in micrometers of a pre-cold-rolled titanium strip, and cold-rolling said pre-cold-rolled titanium strip under the condition such that $$X \leqq 48673/Y^{1.3283}$$

wherein X is the average grain size in micrometers of the pre-cold-rolled titanium strip, and Y is the diameter in millimeters of the rolls used for cold-rolling.

2. The method according to claim 1, wherein said cold rolling is carried out under the condition such that $$X \leqq 10303/Y^{1.3283}.$$

3. The method according to claim 1, wherein said cold rolling is carried out under the condition such that $$X \leqq 365/Y^{1.3283}.$$

4. The method according to claim 1, 2 or 3, wherein an oil having a saponification value of at least 130 is used as the lubricant for the cold-rolling.

5. The method according to claim 1, 2 or 3, wherein an oil having a saponification value of at least 170 is used as the lubricant for the cold-rolling.

* * * * *